United States Patent [19]

Grissom

[11] Patent Number: 5,022,235

[45] Date of Patent: Jun. 11, 1991

[54] BEVERAGE COOLER APPARATUS

[76] Inventor: Tovey L. Grissom, Rte.I #13, Box 616, Bedford, Ind. 47421

[21] Appl. No.: 361,996

[22] Filed: Jun. 5, 1989

[51] Int. Cl.[5] ..... F25D 3/08

[52] U.S. Cl. ..... 62/457.4; 62/372; 62/530

[58] Field of Search ..... 220/903, 426; 62/372, 62/457.4, 457.2, 530

[56] References Cited

U.S. PATENT DOCUMENTS

| | | | |
|---|---|---|---|
| 2,302,639 | 11/1942 | Moore | 62/372 X |
| 4,163,374 | 8/1979 | Moore et al. | 62/457.4 |
| 4,324,111 | 4/1982 | Edwards | 62/457.4 |
| 4,741,176 | 5/1988 | Johnson et al. | 62/457.4 |
| 4,768,354 | 9/1988 | Barnwell | 62/457.4 |
| 4,782,670 | 11/1988 | Long et al. | 62/530 |
| 4,798,063 | 1/1989 | Rimmer | 62/457.4 |
| 4,813,558 | 3/1989 | Fujiyoshi | 220/503 X |

*Primary Examiner*—Lloyd L. King

*Attorney, Agent, or Firm*—Leon Gilden

[57] ABSTRACT

A beverage cooler apparatus is set forth wherein a first cup-shaped support has receivably mounted therewithin a second cup-shaped support formed of insulative foam-like material. The first and second supports include aligned recesses directed downwardly from their respective upper top surfaces formed within their respective walls. Modifications may include a diametrically aligned pair of second recesses formed within the outer and inner cup-shaped supports to a depth less than that of the first recesses to provide a finger access recess to cooperate with the forward drinking recesses. A further modification may include a cylindrical sponge-like insert replaceably mounted within a second cup-shaped support or a selective use of a refrigerant cylinder positionable within the first cup-shaped support with an overlying cylindrical sponge-like insert of a height substantially equal to that of the height of the external cup-shaped support to a position at the lowermost portion of the first drinking recess.

1 Claim, 4 Drawing Sheets

BEVERAGE COOLER APPARATUS

BACKGROUND OF THE INVENTION

1. Field of the Invention

The field of invention relates to beverage cooler apparatus, and more particularly pertains to a new and improved beverage cooler apparatus wherein the same utilizes plural cup-shaped supports and selective inserts for maintaining a beverage container at a desired temperature level.

2. Description of the Prior Art

The use of beverage receiving containers is well known in the prior art. The prior art has utilized apparatus of various configurations and relationships to accommodate a beverage container therewithin to maintain that container at a desired, predetermined temperature to enhance the portability of such beverages. Examples of the prior art include U.S. Pat. No. 3,302,428 to Stoner providing a rigid external container with an interior chamber to receive a coolant medium therewith.

U.S. Pat. No. 4,232,532 to Marsh sets forth a bottle temperature controlling apparatus wherein inner and outer compartments are concentrically arranged with an inner compartment formed of a heat conducting material and a first fluid medium wherein the bottle is arranged within the inner chamber of the device as a heat energy transfer control to control heat transfer between the bottle and the fluid medium U.S. Pat. No. 4,768,354 to Barnwell sets forth an exterior insulating container with an interior medium to maintain the temperature level of a container secured within the apparatus. As is typical of the prior art, the beverage container must project above the upper terminal edge of the apparatus to enable access thereto by a user, wherein the instant invention utilizes aligned recesses within inner and outer liners to enable a user oral access to the container.

U.S. Pat. No. 4,299,100 to Crisman sets forth a beverage cooling container with a series of liners to maintain a predetermined temperature level of a container therewithin.

U.S. Pat. No. 4,741,176 to Johnson sets forth a beverage cooler with a cylindrical freezer pack placed into a cup with a cover to maintain a beverage container at a lower temperature for an extended time period.

As such, it may be appreciated that there is a continuing need for a new and improved beverage cooler apparatus wherein the same addresses both the problems of effectiveness in construction and ease of use, and in this respect, the present invention substantially fulfills this need.

SUMMARY OF THE INVENTION

In view of the foregoing disadvantages inherent in the known types of beverage cooler apparatus now present in the prior art, the present invention provides a beverage cooler apparatus wherein the same utilizes a series of aligned cup-shaped containers to receive a beverage container of a substantially equal height wherein aligned recesses within the walls of the cup-shaped supports enable access by a user to the beverage container therein. As such, the general purpose of the present invention, which will be described subsequently in greater detail, is to provide a new and improved beverage cooler apparatus which has all the advantages of the prior art beverage cooler apparatus and none of the disadvantages.

To attain this, the present invention includes an inner and outer cup-shaped support. The outer cup-shaped support is of relatively rigid construction to receive the interior cup-shaped support of a complementary external configuration to that defined by the internal configuration of the external support. The supports are of a height substantially equal to that of an associated beverage container wherein each includes a recess from an upper terminal top surface of each support aligned relative to one another to enable access to the container by a user. The external and internal supports may include diametrically aligned second recesses of a lesser depth of those of the first recess to enable finger access to the container to enable enhanced removal of the container from the supports. An optional cylindrical sponge insert may be positioned within the internal support to accommodate accessed condensation from the container and further enable convenient wiping pad for the container prior to its insertion within the apparatus. Additionally, a further sponge-like cup-shaped support may be inserted within the interior cup-shaped support to accommodate condensation over the entire exterior surface of the container up to the first recesses with inclusion of a refrigerant pack positioned within the sponge-like cup-shaped insert.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beverage cooler apparatus which has all the advantages of the prior art beverage cooler apparatus and none of the disadvantages.

It is another object of the present invention to provide a new and improved beverage cooler apparatus which may be easily and efficiently manufactured and marketed.

It is a further object of the present invention to provide a new and improved beverage cooler apparatus which is of a durable and reliable construction.

An even further object of the present invention is to provide a new and improved beverage cooler apparatus which is susceptible of a low cost of manufacture with regard to both materials and labor, and which accordingly is then susceptible of low prices of sale to the consuming public, thereby making such beverage cooler apparatus economically available to the buying public.

Still yet another object of the present invention is to provide a new and improved beverage cooler apparatus which provides in the apparatuses and methods of the prior art some of the advantages thereof, while simultaneously overcoming some of the disadvantages normally associated therewith.

Still another object of the present invention is to provide a new and improved beverage cooler apparatus wherein the same utilizes a plurality of cup-shaped inserts nestable within one another with aligned recesses to provide oral access to an included container to enable the cup-shaped supports to be formed of a height substantially equal to that of an inserted container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
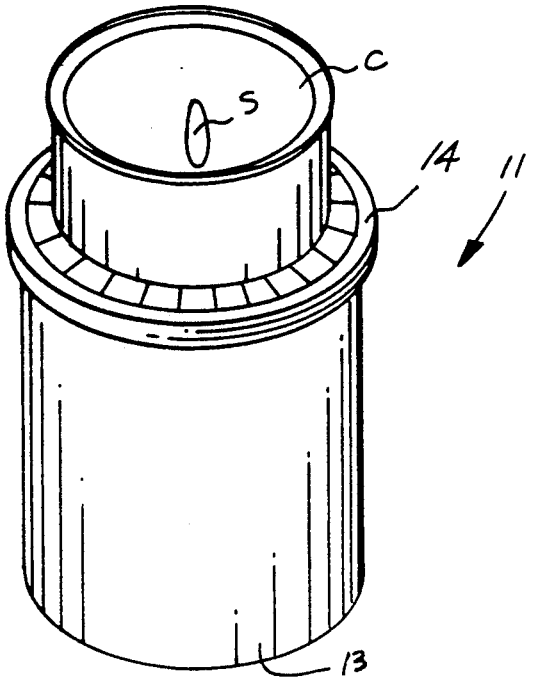
FIG. 1 is an isometric illustration of a typical prior art beverage cooler apparatus.

With reference now to the drawings, and in particular to FIGS. 1 to 8 thereof, a new and improved beverage cooler apparatus embodying the principles and concepts of the present invention and generally designated by the reference numerals 10 and 12 will be described.

Figure 2:
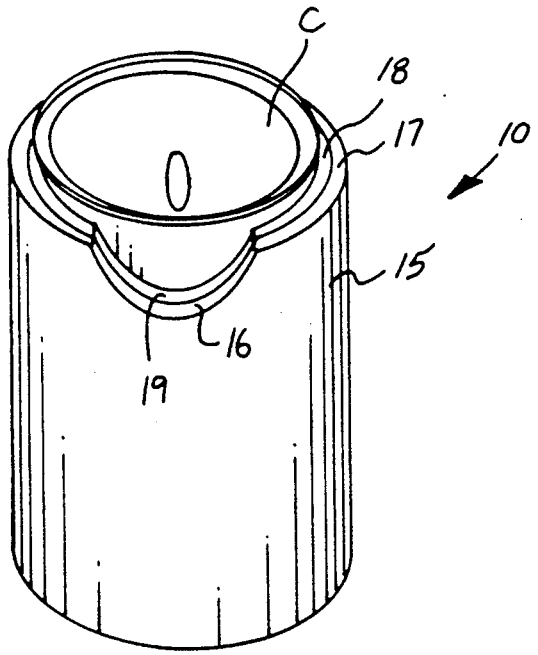
PRIOR ART Fig 2
FIG. 2 is an isometric illustration of a beverage cooler apparatus of the instant invention.

More specifically, the beverage cooler apparatus 10 of the instant invention is distinguished from the prior art beverage cooler containers 11, as illustrated in FIG. 1. The prior containers have typically utilized a single or even plural cup-shaped support 13 provided with a cap with interior flaps 14 to secure a beverage container "C" therewithin. The beverage container "C" is of standard, predetermined height and must necessarily extend beyond the upper terminal surface of the cap 14 to enable oral access to the spout "S" of the container "C". In contradistinction, the instant invention utilizes a beverage cooler apparatus 10 of a height substantially equal to that defined by the beverage container "C". The apparatus 10 includes a first rigid cup-shaped support 15 formed with a first drinking recess 16 formed downwardly from a top peripheral surface 17 through the defined cylindrical wall of the first support 15. A second flexible insulated cup-shaped support 18 is formed of an insulative polymeric type material and is of an external configuration complementary to that defined by internal configuration of the first support 15. The second support 18 includes a second aligned drinking recess 19 aligned with the first drinking recess 16 when the second support is nested within the first support, as illustrated in FIG. 2 for example, and includes an internal depth substantially equal to that of the height of the container "C" to receive the container "C" therewithin in a manner to slightly compress the second support 18 and securely retain the container "C".

Figure 3:
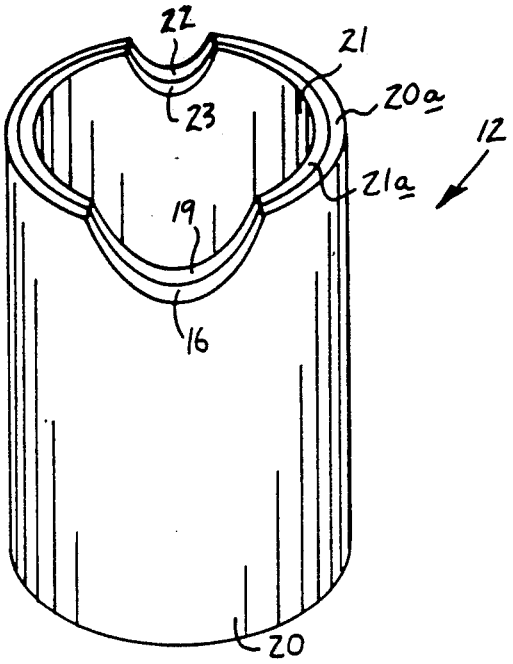
FIG. 3 is an isometric illustration of a modification of the instant invention.
Figure 4:
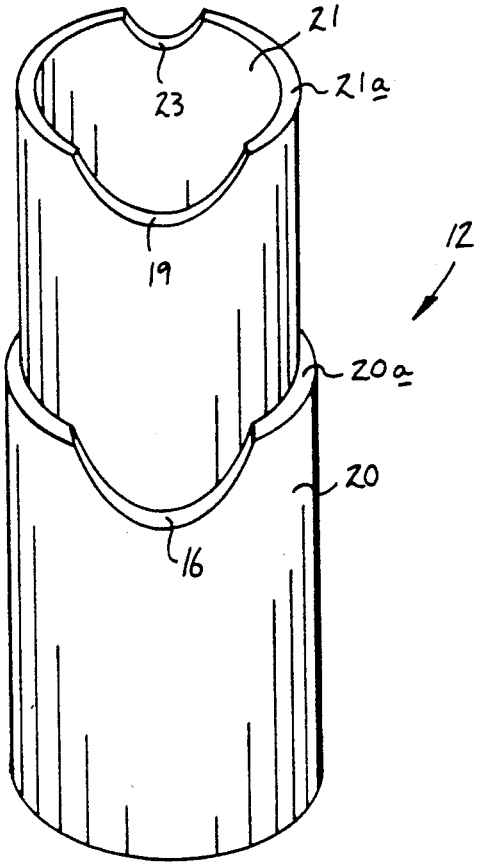
FIG. 4 is an isometric illustration, somewhat exploded, of the beverage cooler apparatus set forth in FIG. 3.

FIG. 3 is illustrative of a modified beverage cooler apparatus formed with a modified first cup-shaped support 20 formed of a rigid insulative material comparable to that as utilized in the first cup-shaped support 15 defining a top rigid surface 20*a* with a first finger recess 22 diametrically aligned with the first drinking recess 16, but of a depth less than that of the drinking recess 16 as the finger recess 22 need merely accommodate an individual's finger to enhance removal of a container from within the apparatus. A further second flexible insulated cup-shaped support 21 similarly includes a top surface 21*a* with a second finger recess 23 diametrically opposed to and aligned with the first drinking recess 16, the second drinking recess 19, and the first finger recess 22 of the rigid cup-shaped support 20.

Figure 5:
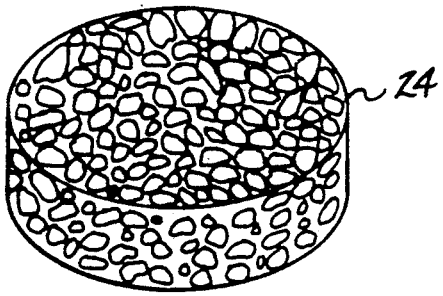
FIG. 5 is an isometric illustration of a cylindrical sponge insert utilized within the internal or second cup-shaped support.
Figure 6:
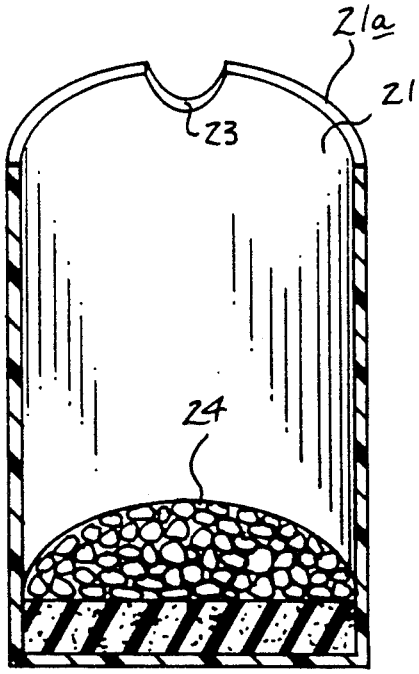
FIG. 6 is an isometric illustration of the second cup-shaped support with the sponge insert positioned therewithin.

Reference to FIG. 5 illustrates a cylindrical sponge insert 24 positionable within the further second cup-shaped support 21. The cylindrical insert 24 is compressible and accommodates condensation from an associated container "C" positioned therewithin. The sponge insert 24 is of a thickness substantially less than the fixed height of the second cup-shaped support 21 to accommodate a beverage container "C" therewithin without the container projecting above the top surface 21*a* an appreciable distance. The sponge insert 24 may be further utilized to wipe off moisture and contaminants from an upper surface of the container "C" prior to its use.

Figure 7:
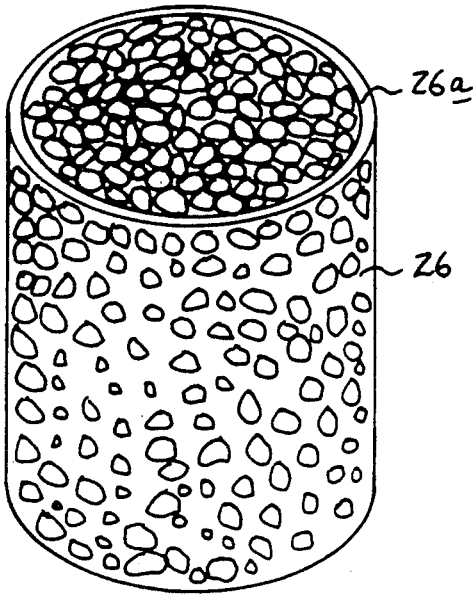
FIG. 7 is an isometric illustration of a third cup-shaped support positionable within a second cup-shaped support.
Figure 8:
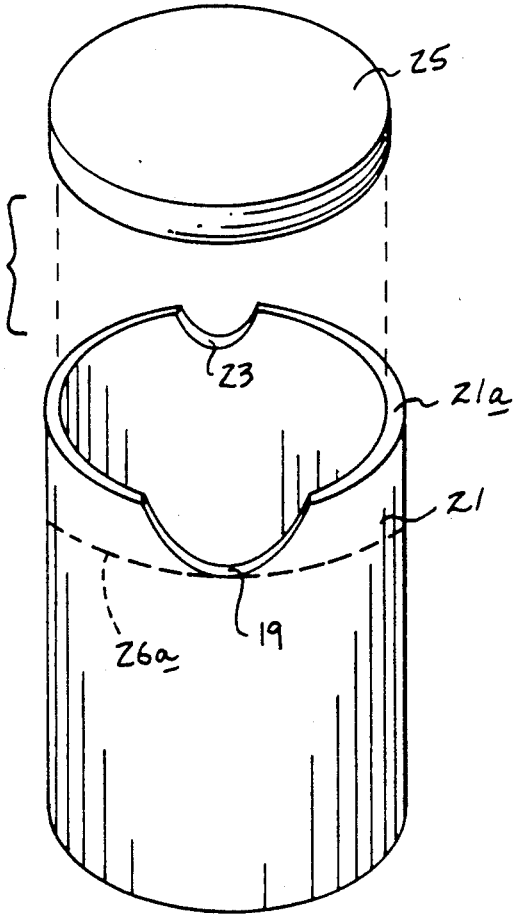
FIG. 8 is an isometric illustration, somewhat exploded, of a second cup-shaped support with a refrigerant cylinder selectively positionable therewithin.

FIG. 7 illustrates a cylindrical sponge insert 24 positionable within the second insulated cup-shaped support 21 to enhance the moisture absorption characteristics of the cylindrical insert 24. In its use, the container "C" is positioned within the insert 26 prior to its positioning within the second support 21. Additionally, a refrigerant cylinder 25 of a predetermined thickness may be positioned within the second insert 21 to enhance the cooling effect of the apparatus. Reference to FIG. 8 illustrates the top surface 26*a* and its positioning within the second support 21, as the height of the cup-shaped sponge insert 26 is substantially equal to that defined by the lowermost edge of the second drinking recess 19.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be emcompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beverage cooler apparatus for securement of a beverage container therein wherein said beverage container is of a predetermined height, said apparatus comprising, a first cylindrical cup-shaped support defined by a first cylindrical wall formed to a first floor defining a first internal configuration, and a second cylindrical cup-shaped support receivable within said first cup-shaped support defined by a second cylindrical wall formed to a second floor with an external configuration equal to said first internal configuration, and the first and second cup-shaped supports each including a respective first and second top edge, and a first drinking recess formed downwardly from said first top edge through said first cylindrical wall, and a second drinking recess formed downwardly from said second top edge through said second cylindrical wall, and the first and second drinking recesses each defined by a first depth and the first and second drinking recesses aligned with one another when the second cup-shaped support is positioned within the first cup-shaped support, and the second cup-shaped support defined by a height substantially equal to the predetermined height of said beverage container, and wherein the first cup-shaped support is formed of a rigid insulative material, and the second cup-shaped support is formed of a flexible insulative material, and further including a first finger recess formed downwardly from the first top edge within the first cup-shaped support through said first cylindrical wall, and a second finger recess formed downwardly from said top edge through said second cylindrical wall, and the first and second cylindrical recess diametrically opposed to the respective first and second recess when the second cup-shaped support is positioned within the first cup-shaped support, and the first and second cylindrical recess are aligned with one another when the second cup-shaped support is positioned within the first cup-shaped support, and the first and second finger recess are of a second depth less than the first depth, and further including a cylindrical sponge defined by an external diameter equal to the internal diameter of the second cup-shaped support and of a thickness substantially less than that of the predetermined height, and the sponge is replaceably mounted onto the floor of the second cup-shaped support and formed of a moisture absorbent material, and further including a cylindrical sponge insert formed of a cylindrical sponge external configuration substantially equal to an internal configuration defined by the second cup-shaped support, and the cylindrical sponge insert of a height defined between a lowermost portion of the second drinking recess and the second floor of the second cup-shaped support, and the cylindrical sponge insert formed of a compressible moisture absorbent material, and further including a replaceable refrigerant insert selectively positionable within the second cup-shaped support or the cylindrical sponge insert.

* * * * *